US011577518B2

(12) United States Patent
Hayashi et al.

(10) Patent No.: US 11,577,518 B2
(45) Date of Patent: Feb. 14, 2023

(54) PRINTER AND METHOD FOR DETECTING ABNORMAL EVENT IN PRINTER

(71) Applicant: Brother Kogyo Kabushiki Kaisha, Aichi-Ken (JP)

(72) Inventors: Masayoshi Hayashi, Nagoya (JP); Yuta Toda, Nagoya (JP); Ryuji Horata, Gamagori (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 41 days.

(21) Appl. No.: 17/216,158

(22) Filed: Mar. 29, 2021

(65) Prior Publication Data

US 2021/0300047 A1 Sep. 30, 2021

(30) Foreign Application Priority Data

Mar. 31, 2020 (JP) ..... JP2020-063835

(51) Int. Cl.
*B41J 2/165* (2006.01)

(52) U.S. Cl.
CPC ..... *B41J 2/16579* (2013.01); *B41J 2/16511* (2013.01); *B41J 2/16523* (2013.01); *B41J 2/16547* (2013.01); *B41J 2002/16582* (2013.01)

(58) Field of Classification Search
CPC ..... B41J 2/16579; B41J 2/16511; B41J 2/16523; B41J 2/16547
See application file for complete search history.

(56) References Cited

U.S. PATENT DOCUMENTS

2011/0090284 A1* 4/2011 Ito ..... B41J 2/14274 347/44

FOREIGN PATENT DOCUMENTS

| | | | |
|---|---|---|---|
| JP | 2007-112086 A | | 5/2007 |
| JP | 2009226620 A | * | 10/2009 |
| JP | 2010-058406 A | | 3/2010 |
| JP | 2014-061674 A | | 4/2014 |
| JP | 2020196165 A | * | 12/2020 |

* cited by examiner

*Primary Examiner* — Sharon Polk
(74) *Attorney, Agent, or Firm* — Banner & Witcoff, Ltd.

(57) ABSTRACT

A printer includes a head, an electrode, a moving unit, a voltage application circuit, and a controller. The head has an ejection surface having a nozzle. The head is configured to eject liquid from the nozzle. The moving unit is configured to move at least one of the electrode or the head. The voltage application circuit is configured to apply a certain voltage between the head and the electrode. The controller is configured to: drive the moving unit such that the ejection surface faces the electrode; drive the voltage application circuit to apply the certain voltage between the head and the electrode; compare a level of an output signal input to the controller from the electrode with a particular threshold; and based on the comparison result, determine that liquid is present between the ejection surface and the electrode.

12 Claims, 11 Drawing Sheets

PRINTER AND METHOD FOR DETECTING ABNORMAL EVENT IN PRINTER

CROSS-REFERENCE TO RELATED APPLICATION

This application claims priority from Japanese Patent Application No. 2020-063835 filed on Mar. 31, 2020, the content of which is incorporated herein by reference in its entirety.

TECHNICAL FIELD

Aspects of the disclosure relates to a printer and a method for detecting an abnormal event in the printer.

BACKGROUND

In a known printer, a controller determines whether liquid has been ejected from respective nozzles of a head. More specifically, in response to receiving a liquid ejection instruction from the controller, the head attempts to eject liquid from the respective nozzles toward an electrode. The controller determines, based on changes in voltage at the electrode, whether liquid has been ejected from the respective nozzles.

SUMMARY

In such a known printer, a current leakage or an electric discharge may occur between the nozzles and the electrode due to various factors.

Accordingly, aspects of the disclosure provide a printer and a method for determining whether an abnormal event has occurred in the printer, wherein the abnormal event may be caused by liquid present between a liquid ejection surface of a head and an electrode.

In one or more aspects of the disclosure, a printer may include a head, an electrode, a moving unit, a voltage application circuit, and a controller. The head may have an ejection surface having a nozzle. The head may be configured to eject liquid from the nozzle. The moving unit may be configured to move at least one of the electrode or the head. The voltage application circuit may be configured to apply a certain voltage between the head and the electrode. The controller may be configured to: drive the moving unit such that the ejection surface faces the electrode; drive the voltage application circuit to apply the certain voltage between the head and the electrode; compare a level of an output signal with a particular threshold; and based on the comparison result, determine that liquid is present between the ejection surface and the electrode. The output signal may be output from the electrode and input to the controller.

In one or more aspects of the disclosure, a method for detecting an abnormal event in a printer that includes: a head having a liquid ejection surface having a nozzle and configured to eject liquid from the nozzle; an electrode; a moving unit configured to move at least one of the electrode or the head; a voltage application circuit configured to apply a certain voltage between the head and the electrode; a relay circuit connected to the electrode; a cap configured to cover the nozzle; a wiper configured to wipe the ejection surface of the head; and a suction pump connected to the cap, may include: facing the liquid ejection surface and the electrode each other; applying the certain voltage between the head and the electrode; determining whether a level of a first signal output from the electrode and input to the controller via the relay circuit has exceeded a first threshold; in response to a determination that the level of the first signal has not exceeded the first threshold, determine whether a level of a second signal output from the electrode and input directly to the controller has exceeded a second threshold; in response to a determination that the level of the second signal has exceeded the second threshold, execute maintenance; subsequent to the maintenance, applying the certain voltage between the head and the electrode; and determining whether the level of the first signal output from the electrode has exceeded the first threshold.

According to one or more aspects of the disclosure, the printer and the method may determine that liquid is present between the liquid ejection surface and the electrode in the printer. In a case where liquid is present between the liquid ejection surface, the liquid may be removed before the presence or absence of an ejection failure is detected. Thus, the printer and the method may correctly determine whether an ejection failure has occurred.

DETAILED DESCRIPTION

First Illustrative Embodiment

Hereinafter, a first illustrative embodiment will be described with reference to appropriate ones of the accompanying drawings.

Figure 1:
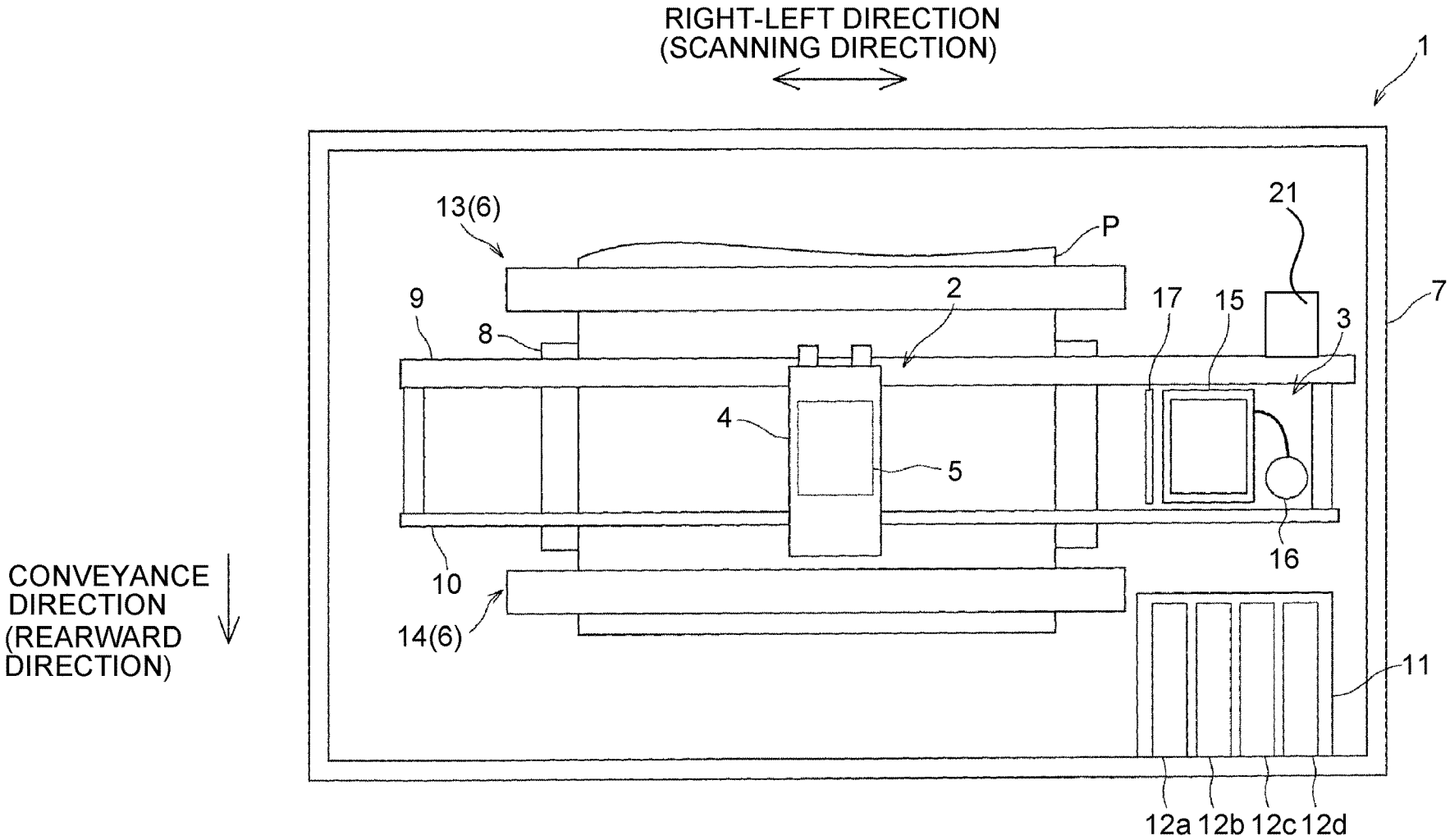
FIG. 1 is a schematic top view of a printer.

A printer 1 may be an inkjet printer. With reference to an orientation of the printer 1 that may be disposed in a horizontal plane in an orientation in which it may be intended to be used, a side facing out of the page of FIG. 1 is defined as an upper side of the printer 1, and a side facing into the page of FIG. 1 is defined as a lower side of the printer 1. Directions of up, down, right, left, front, and rear of the printer 1 may be defined as shown in the drawings. A right-left direction and a front-rear direction may be also defined as illustrated in the drawings. The right-left direction and the front-rear direction are parallel to a horizontal direction. As illustrated in FIG. 1, the printer 1 includes a printing unit 2 and a maintenance unit 3. The printing unit 2 is configured to record an image onto a recording sheet P.

The maintenance unit 3 is configured to perform maintenance on a head 5 of the printing unit 2.

The printing unit 2 includes a carriage 4, the head 5, and a conveyor 6. The carriage 4 is movable back and forth along a scanning direction, i.e., in the right-left direction. The head 5 is mounted on the carriage 4. The conveyor 6 is configured to convey a recording sheet P along a conveyance direction in the horizontal plane. The conveyance direction is orthogonal to the scanning direction. That is, the conveyor 6 is configured to convey a recording sheet P toward the front of the printer 1. The printer 1 further includes a housing 7, a platen 8, and guide rails 9 and 10. The platen 8 and the guide rails 9 and 10 are disposed inside the housing 7. The platen 8 extends in the horizontal direction. The platen 8 may support a recording sheet P thereon. The guide rails 9 and 10 are disposed above the platen 8 and extend parallel to the scanning direction. The carriage 4 is connected to a drive train that may include gears and belts and be connected to a carriage drive motor 21. The carriage drive motor 21 is an example of a moving unit. In response to the carriage drive motor 21 being driven, the carriage 4 moves in the scanning direction along the guide rails 9 and 10 within a particular range in which the carriage 4 can face a recording sheet P placed on the platen 8.

The head 5 is disposed at a lower portion of the carriage 4. When the head 5 faces the platen 8, a clearance is left between the head 5 and the platen 8. The head 5 has a lower surface that may be an ejection surface 5*a*. The ejection surface 5*a* extends in the horizontal direction. The ejection surface 5*a* has nozzles 22, from each of which ink is to be ejected. Ink is an example of liquid. The head 5 mounted on the carriage 4 is connected to an ink cartridge holder 11 via tubes. The ink cartridge holder 11 may hold four ink cartridges. In the first illustrative embodiment, the ink cartridge holder 11 holds ink cartridges 12*a*, 12*b*, 12*c*, and 12*d* that store magenta ink, cyan ink, yellow ink, and black ink, respectively, and the four color inks are supplied to the head 5 via the tubes from the respective ink cartridges 12*a*, 12*b*, 12*c*, and 12*d*.

The head 5 is movable to beyond the particular range in the scanning direction. More specifically, the head 5 is movable further to the right and the left than the particular range. A position further to the right than the particular range may be a carriage standby position where the carriage 4 waits on standby when the head 5 is not used. When the carriage 4 is located at the carriage standby position, the head 5 is positioned above the maintenance unit 3 and thus faces the maintenance unit 3.

The conveyor 6 includes a plurality of conveyance rollers 13 and 14. The platen 8 and the carriage 4 are disposed between the conveyance rollers 13 and 14 in the front-rear direction. The conveyance rollers 13 and 14 are connected to a drive train that may include gears and belts and be connected to a conveyance motor. In response to the conveyance motor being driven, the conveyance rollers 13 and 14 rotate to convey a recording sheet Pin the conveyance direction so that the recording sheet P passes between the head 5 and the platen 8.

The printing unit 2 is configured to record an image on a recording sheet P supported by the platen 8 by performing scanning and sheet conveyance alternately. In scanning, the printing unit 2 ejects ink from the head 5 while moving the carriage 4 in the scanning direction. In sheet conveyance, the printing unit 2 conveys a recording sheet P by the conveyance rollers 13 and 14 in the conveyance direction.

The maintenance unit 3 is disposed to the right of the platen 8. In other words, when the carriage 4 is located at the carriage standby position, the maintenance unit 3 faces the head 5. The maintenance unit 3 includes a cap 15, a suction pump 16, and a wiper 17.

The cap 15 is movable up and down by control of a cap drive unit. The cap drive unit includes a drive source such as a motor and a power transmission such as gears. Moving the cap 15 upward by the cap drive unit brings the cap 15 into close contact with the ejection surface 5*a* of the head 5 to covers orifices 41*a* of the nozzles 22.

The suction pump 16 is connected to the cap 15 via a tube. The maintenance unit 3 is configured to perform, as maintenance, a suction purge using the suction pump 16. In a suction purge, in a state where the cap 15 covers the nozzles 22, air inside the cap 15 is sucked out using the suction pump 16 to reduce pressure inside the cap 15, thereby discharging ink forcedly from the nozzles 22 to the inside of the cap 15. Through the suction purge, thickened ink or bubbles and/or dust entrained in ink is discharged from the nozzles 22 to the inside of the cap 15. The suction purge may thus reduce or prevent an occurrence of an ejection failure, and recover ejection performance of the head 5 when an ejection failure has occurred.

The wiper 17 includes a rubber blade. The wiper 17 is disposed to the left of the cap 15. The wiper 17 is held by a holder and is movable in an up-down direction. The maintenance unit 3 is configured to perform, as maintenance, wiping using the wiper 17. The wiper 17 is located at a wiper standby position during printing and at a wiping position during wiping. At the wiper standby position, the wiper 17 is not allowed to contact the ejection surface 5*a*. At the wiping position, the wiper 17 is allowed to contact the ejection surface 5*a*. In a state where the wiper 17 is located at the wiping position, the carriage 4 moves in the scanning direction from the carriage standby position toward the platen 8. Thus, the wiper 17 comes into contact with the ejection surface 5*a* to wipe ink off from the ejection surface 5*a*. In a suction purge, after ink is forcedly discharged from the nozzles 22 to the inside of the cap 15 using the suction pump 16, ink remaining on the ejection surface 5*a* is wiped off using the wiper 17.

Figure 2:
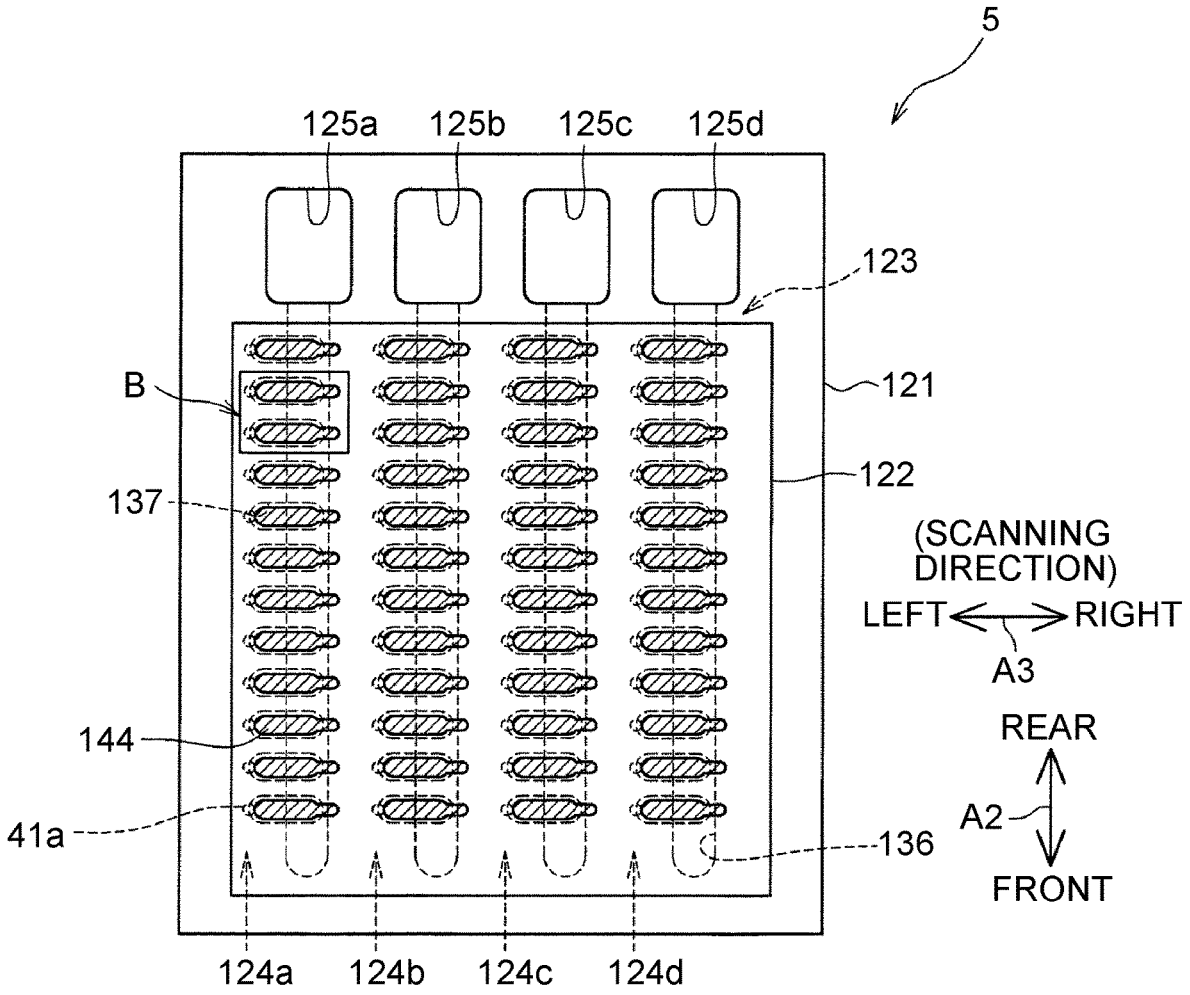
FIG. 2 is a plan view of a head of the printer of FIG. 1.
Figure 3:
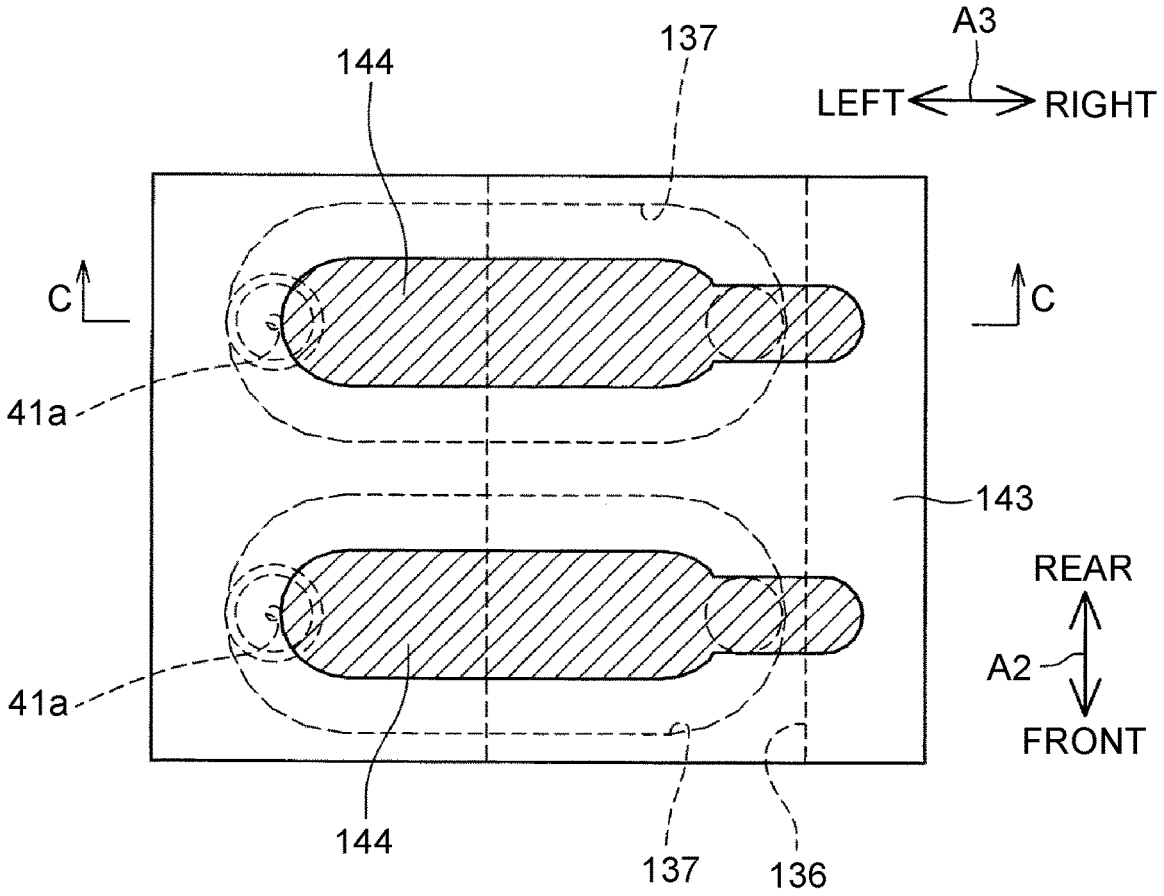
FIG. 3 is an enlarged view of a particular portion B of FIG. 2.
Figure 4:
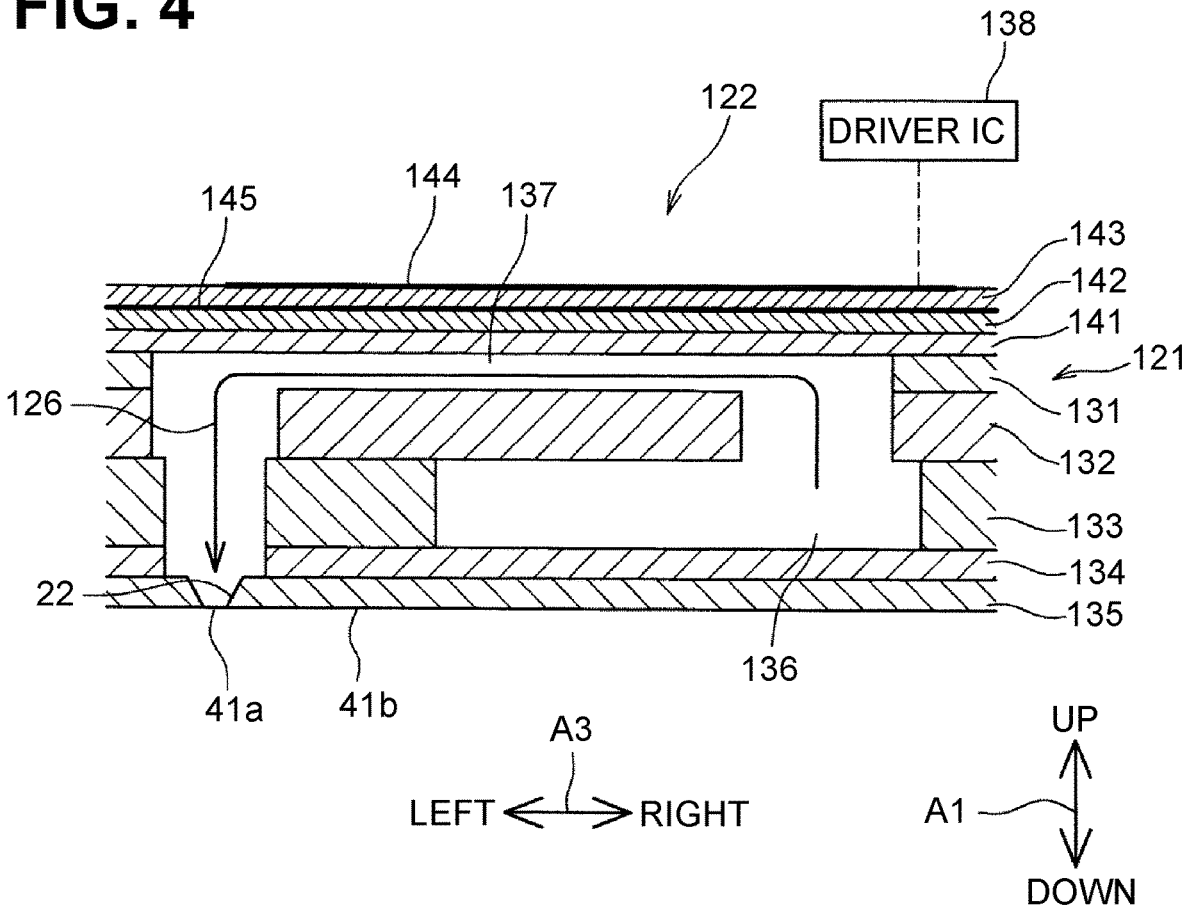
FIG. 4 is a sectional view taken along line C-C of FIG. 3.

Referring to FIGS. 2, 3, and 4, the head 5 will be described in detail.

The head 5 includes a channel unit 121 and an actuator unit 122. As illustrated in FIG. 4, the channel unit 121 includes a plurality of plates 131, 132, 133, 134, and 135 that are stacked one above another. The plate 135 may be the lowest plate among the plates 131, 132, 133, 134, and 135, and has the nozzles 22 defined therein. Each nozzle 22 has an orifice 41*a*. The other plates 131, 132, 133, and 134 each have apertures such as manifolds 136 and pressure chambers 137 that are in communication with the corresponding nozzles 22.

As illustrated in FIG. 2, the orifices 41*a* are arranged in four rows 124. In each row 124, the orifices 41*a* are aligned in a front-rear direction A2. The rows 124 are disposed next to each other in a right-left direction A3. In the first illustrative embodiment, black ink is ejected from the orifices 41*a* belonging to the rightmost row 124*d* in the scanning direction in FIG. 2, and color inks (e.g., a yellow ink, a cyan ink, and a magenta ink) are ejected from the orifices 41*a* belonging to the other rows 124*a*, 124*b*, and 124*c*. More specifically, yellow ink is ejected from the orifices 41*a* belonging to the leftmost row 124*a* in the scanning direction in FIG. 2. Cyan ink is ejected from the orifices 41*a* belonging to the row 124*b* to the right of the row 124*a*. Magenta ink is ejected from the orifices 41*a* belonging to the row 124*c* to the right of the row 124*b*.

Hereinafter, a description will be provided on a structure of channels that are defined in the plates 131, 132, 133, and 134 of the channel unit 121. These channels are in communication with the corresponding nozzles 22. As illustrated in FIG. 2, the channel unit 121 has a plurality of ink inlets 125, at its rear end portion, that is, at its upstream end portion in the conveyance direction. The ink inlets 125 are disposed next to each other in the right-left direction A3. The head 5 is supplied with ink of four colors from a sub tank via the respective ink inlets 125. The ink inlets 125 includes a yellow ink inlet 125*a*, a cyan ink inlet 125*b*, a magenta ink inlet 125*c*, and a black ink inlet 125*d*. Each ink inlet 125 is covered by a filter.

The channel unit 121 has a plurality of manifolds 136. Each manifold 136 extends in the front-rear direction A2. The manifolds 136 are connected to the respective ink inlets 125 at their rear ends. In each manifold 136, ink flows frontward from the rear end of the manifold 136.

The channel unit 121 includes the pressure chambers 137 that correspond one to one with the nozzles 22. The pressure chambers 137 are defined in the plate 131 that may be the uppermost plate of the channel unit 121. The pressure chambers 137 are arranged in a matrix. As illustrated in FIG. 2, the pressure chambers 137 are arranged in four rows such that the pressure chamber rows correspond one to one with the orifice rows 124. In each pressure chamber row, the pressure chamber 137 are aligned in the front-rear direction A2. The pressure chamber rows are disposed next to each other in the right-left direction A3. The channel unit 121 includes individual channels 126. As indicated by an arrow in FIG. 4, each individual channel 126 is branched from a corresponding manifold 136 and extends to a corresponding nozzle 22 via a corresponding pressure chamber 137. The manifolds 136 and the individual channels 126 constitute a head channel 123 (refer to FIG. 2) defined in the channel unit 121.

As illustrated in FIGS. 2, 3, and 4, the actuator unit 122 includes a diaphragm 141, piezoelectric layers 142 and 143, a plurality of individual electrodes 144, and a common electrode 145. The diaphragm 141 is adhered to an upper surface of the channel unit 121 and covers the pressure chambers 137. The piezoelectric layers 142 and 143 are stacked one above another on an upper surface of the diaphragm 141. The piezoelectric layer 143 is disposed above the piezoelectric layer 142. The individual electrodes 144 are disposed on an upper surface of the piezoelectric layer 143 so as to face the respective pressure chambers 137. The common electrode 145 is disposed between the piezoelectric layers 142 and 143 and extends over the pressure chambers 137.

In response to receiving a signal from a controller 30, a driver IC 138 provides a drive signal to a particular individual electrode 144. This causes a piezoelectric strain in a portion of the piezoelectric layer 143 facing a pressure chamber 137 corresponding to the particular individual electrode 144, and thus, a corresponding portion of the diaphragm 141 is deformed. Such deformation changes a volume of the pressure chamber 137 corresponding to the particular individual electrode 144. Such a volume change applies pressure to ink stored in a corresponding individual channel 126, thereby ejecting ink from a corresponding nozzle 22 (i.e., a corresponding orifice 41*a*).

Figure 5:
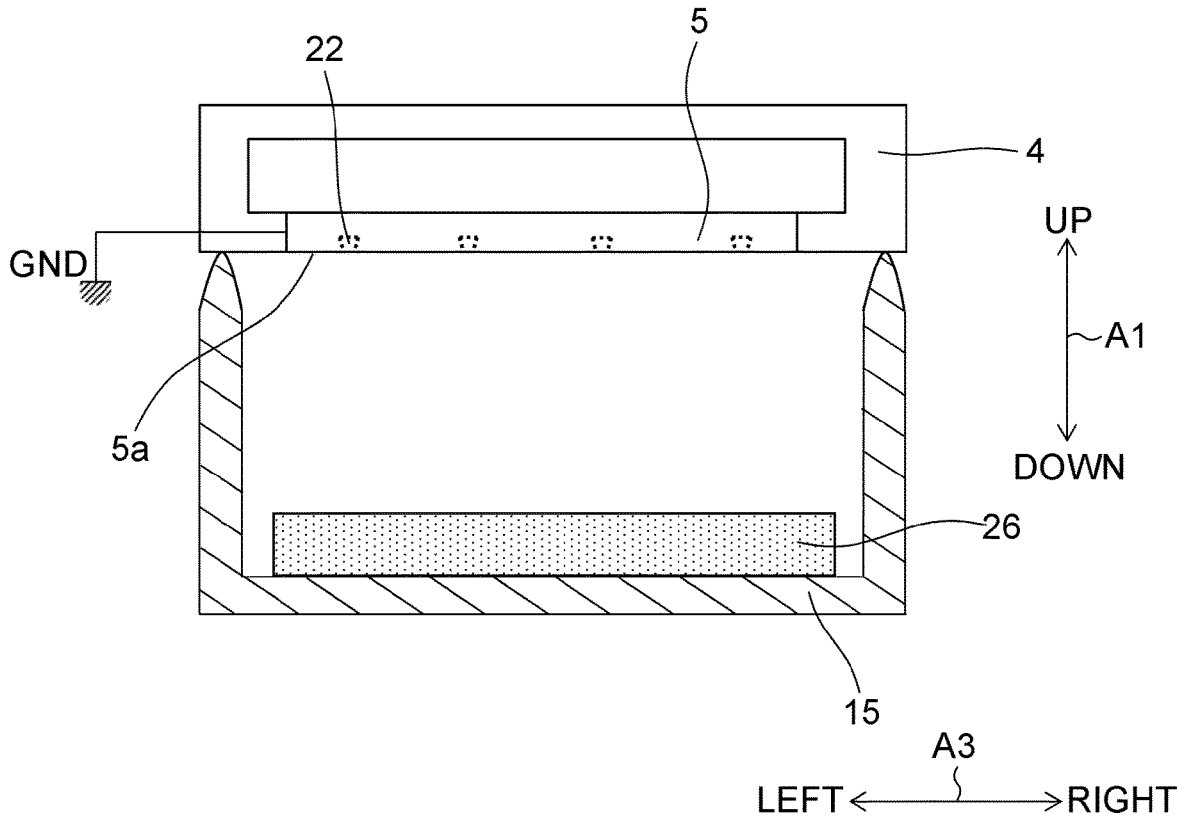
FIG. 5 is a schematic view illustrating a relative positional relationship between the head and a cap when a carriage is located at a carriage standby position.

As illustrated in FIG. 5, an electrode 26 is disposed inside the cap 15. In a state where a potential difference is between the electrode 26 and the head 5, a charged ink (e.g., a negatively-charged ink) is ejected toward the electrode 26 from the nozzle 22. The ejected ink has a polarity opposite to the polarity of the electrode 26. As the charged ink reaches the electrode 26, voltage at the electrode 26 may change. The electrode 26 thus outputs a signal indicating the changes in voltage at the electrode 26. Nevertheless, if ink is accumulated on either or both of the electrode 26 and the ejection surface 5*a*, a current leakage or an electric discharge may occur.

Figure 6:
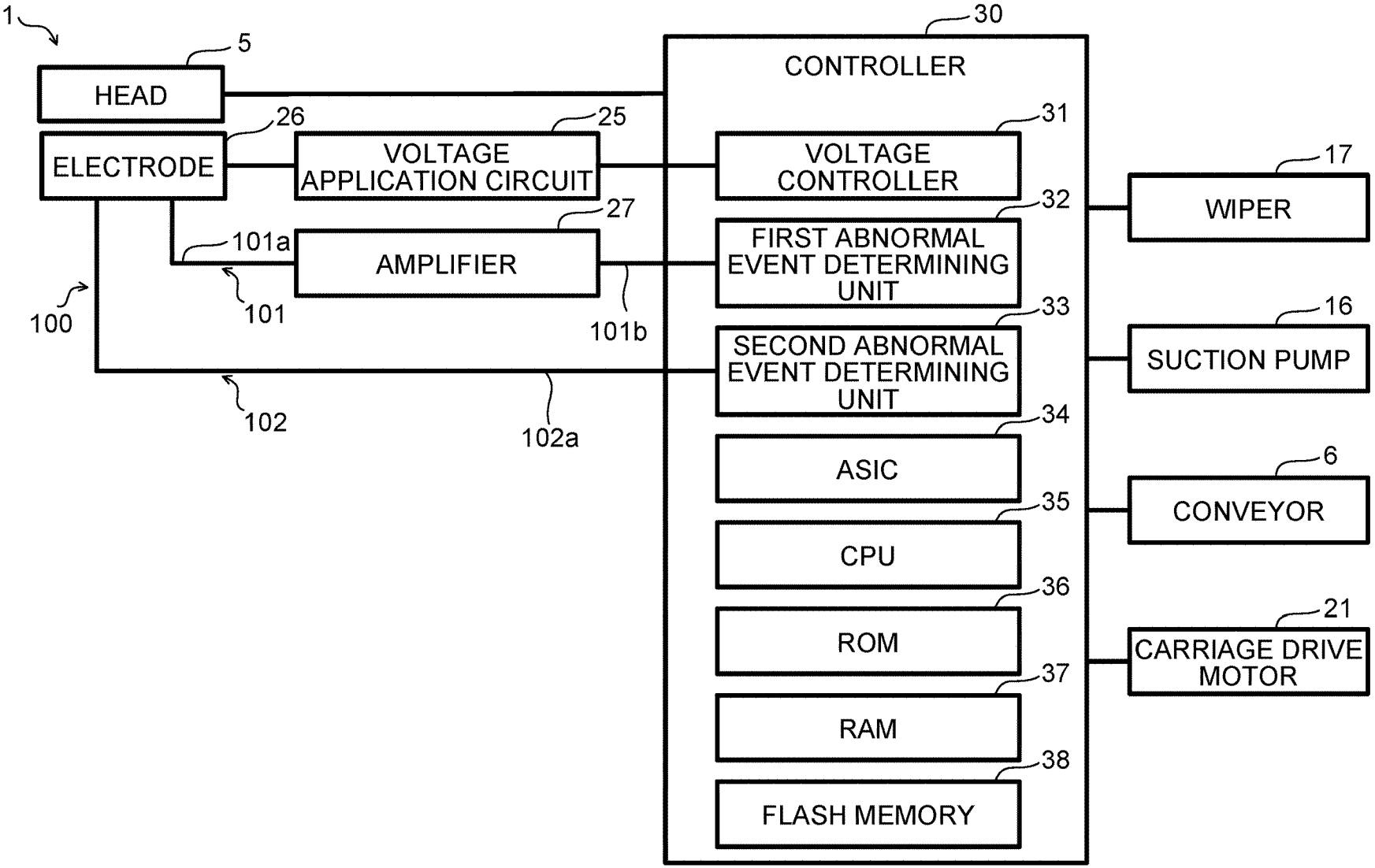
FIG. 6 is a block diagram illustrating an electrical configuration of the printer of FIG. 1.

As illustrated in FIG. 6, the printer 1 further includes a voltage application circuit 25, a relay circuit 100, and the controller 30. The controller 30 includes a voltage controller 31. In response to receiving an instruction from the voltage controller 31, the voltage application circuit 25 causes a certain potential difference between the electrode 26 and the head 5. The voltage application circuit 25 is configured to apply a certain voltage to the electrode 26 to cause the certain potential difference between the electrode 26 and the head 5. Nevertheless, it may be modified such that the voltage application circuit 25 may apply a certain voltage to the head 5 instead of the electrode 26 to cause the certain potential difference between the electrode 26 and the head 5.

The relay circuit 100 is electrically connected to the electrode 26. The relay circuit 100 is configured to relay a signal received from the electrode 26 to the controller 30. The relay circuit 100 includes a first route wiring 101 and a second route wiring 102. The first route wiring 101 is for transmitting a signal output from the electrode 26 to the controller 30 via an amplifier 27. The second route wiring 102 is for transmitting a signal output from the electrode 26 directly to the controller 30. The first route wiring 101 includes a first connecting line 101*a* and a second connecting line 101*b*. The first connecting line 101*a* connects between the electrode 26 and the amplifier 27. The second connecting line 101*b* connects between the amplifier 27 and the controller 30. The second route wiring 102 includes a third connecting line 102*a*. The third connecting line 102*a* connects between the electrode 26 and the controller 30 directly, not via the amplifier 27. A faint signal output from the electrode 26 and transmitted by the first route wiring 101 is amplified by the amplifier 27. This may enable the controller 30 to process the signal received by the first route wiring 101 accurately.

The controller 30 controls operations of components and units of the printer 1. The controller 30 further includes a first abnormal event determining unit 32 and a second abnormal event determining unit 33. The voltage controller 31 transmits, to the voltage application circuit 25, an instruction to apply a voltage to cause the certain potential difference between the electrode 26 and the head 5.

Hereinafter, a description will be provided on abnormal events that may occur in the printer 1. The abnormal events include a first abnormal event and a second abnormal event. Examples of the first abnormal event include an ejection failure that the head 5 fails to eject enough ink from one or more nozzles 22. Examples of the second abnormal event include a failure caused by ink present between the ejection surface 5*a* of the head 5 and the electrode 26.

Figure 7:
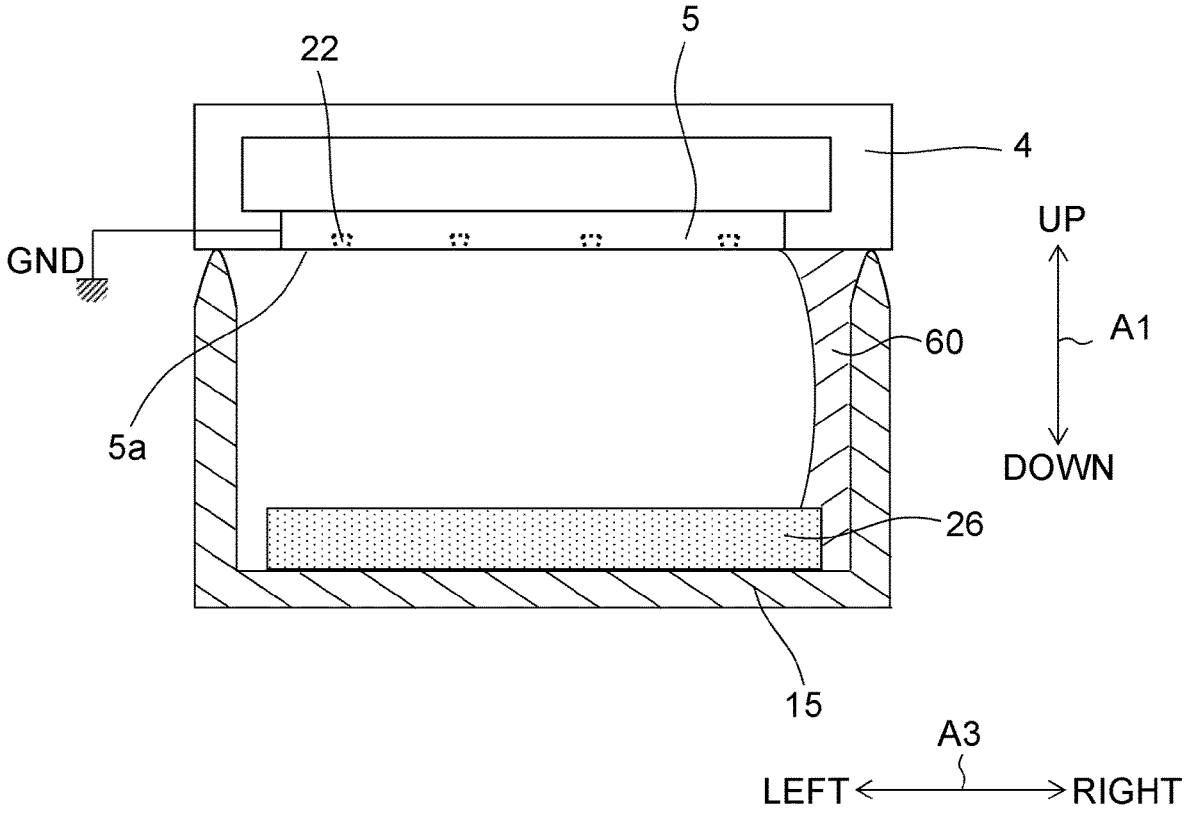
FIG. 7 is an explanatory view of a current leakage that may occur in the printer of FIG. 1.
Figure 8:
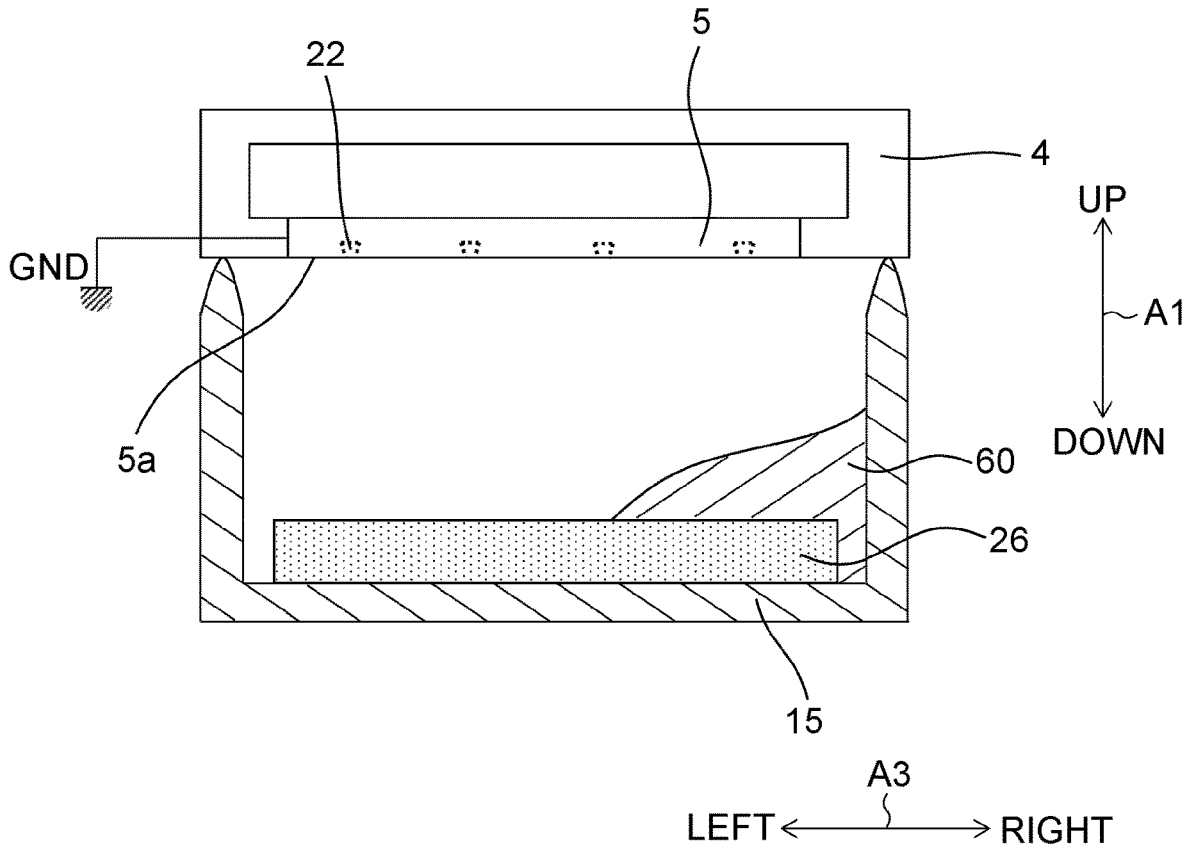
FIG. 8 is an explanatory view of an electric discharge that may occur in the printer of FIG. 1.

More specifically, the second abnormal events include a current leakage and an electric discharge. Referring to FIGS. 7 and 8, the current leakage and the electric discharge will be described in detail. As illustrated in FIG. 7, a current leakage may occur in a case where the voltage application circuit 25 applies the certain voltage to the electrode 26. The current leakage is an unintentional electric current flow through a conductive path that is accumulated ink 60 between the ejection surface 5*a* and the electrode 26.

A current leakage causes electrolysis of ink in the head 5. The electrolysis of ink generates hydrogen in the individual channels 126, thereby increasing pressure acting on ink in the individual channels 126. The electrolysis of ink also causes change of ink characteristics. When a current leakage occurs, a certain amount or more of leakage current flows between a particular nozzle 22 and the electrode 26. A current leakage may cause the plate 134 to peel off in the vicinity of a particular nozzle 22 to which a leakage current flows or may cause deposits formed by the ink electrolysis to build up in the vicinity of the nozzles 22. Thus, if the certain amount or more of leakage current flows to the same nozzle 22 again and again, the plate 134 may peel off significantly or the nozzle 22 may be clogged due to buildup of deposits. These events may cause the nozzle 22 to fail to eject enough ink therefrom.

As illustrated in FIG. 8, an electric discharge may occur between the ejection surface 5*a* and the electrode 26 in a case where the voltage application circuit 25 applies the certain voltage to the electrode 26 because a certain amount or more of ink 60 accumulated on the surface of the electrode 26 is close enough to the ejection surface 5*a* to cause an electric discharge.

The first abnormal event determining unit 32 is configured to determine whether a first abnormal event, that is, an ejection failure has occurred. More specifically, the first abnormal event determining unit 32 is configured to determine, based on a level of a first signal, whether an ejection failure has occurred. The first signal is supplied from the electrode 26 to the first abnormal event determining unit 32 via the first route wiring 101 of the relay circuit 100. Based on the determination that the level of the first signal has not exceeded a first threshold, first abnormal event determining unit 32 determines that the first abnormal event has occurred. The first signal is an example of an output signal. The first threshold is an example of a further particular threshold.

The second abnormal event determining unit 33 is configured to determine whether a second abnormal event, that is, a current leakage or an electric discharge has occurred. More specifically, the second abnormal event determining unit 33 is configured to determine, based on a level of a second signal, whether a second abnormal event has occurred. The second signal is supplied from the electrode 26 to the second abnormal event determining unit 33 via the second route wiring 102 of the relay circuit 100.

As described above, the second abnormal event is caused by ink 60 accumulated between the ejection surface 5*a* of the head 5 and the electrode 26. The potential of the electrode 26 when the voltage application circuit 25 applies the certain voltage to the electrode 26 in a state where a second abnormal event has occurred is greater than the potential of the electrode 26 when ink ejected from a normal nozzle 22 reaches the electrode 26. The normal nozzle 22 refers to a nozzle 22 that does not have an ejection problem. Thus, based on the determination that the level of the second signal has exceeded a second threshold that is greater than the first threshold, the second abnormal event determining unit 33 determines that a second abnormal event has occurred. The second signal is another example of the output signal. The second threshold is an example of a particular threshold.

As illustrated in FIG. 6, the controller 30 further includes an ASIC 34, a CPU 35, a ROM 36, a RAM 37, and a flash memory 38. Each of the ASIC 34 and the CPU 35 is an example of a controller.

Based on an address signal and a bus signal output from the CPU 35, the ASIC 34 generates and outputs a control signal for controlling an access to the ROM 36, the RAM 37, and the flash memory 38. This enables the CPU 35 to fetch an instruction code or data from the ROM 36, the RAM 37, and the flash memory 38 and to write data to the RAM 37 and the flash memory 38.

Based on an address signal and a bus signal output from the CPU 35, the ASIC 34 generates control signals for controlling a respective one of the suction pump 16, the wiper 17, the conveyor 6, and the carriage drive motor 21 and outputs the generated control signals to appropriate components.

The ROM 36 stores a boot program and a control program for controlling the printer 1. The RAM 37 is configured to store work data temporarily. Nevertheless, it may be modified such that the control program stored in the ROM 36 may be transferred to the RAM 37, and the CPU 35 may execute the control program stored in the RAM 37. The flash memory 38 retains data while no power is supplied to the printer 1. Thus, the flash memory 38 stores, for example, data to be referred by the control program every time or next or subsequent time.

The CPU 35 is configured to execute the control program stored in the ROM 36 or the RAM 37 to control the suction pump 16, the wiper 17, the conveyor 6, and the carriage drive motor 21, respectively, in the printer 1.

In the controller 30, only one of the CPU 35 or the ASIC 34 may handle all processing tasks or a combination of the CPU 35 and the ASIC 34 may handle the processing tasks. Alternatively, the controller 30 may include a single CPU 35 that may handle all processing tasks or include a plurality of CPUs 35 that may share the processing tasks. Alternatively, the controller 30 may include a single ASIC 34 that may perform all the processing tasks or include a plurality of ASICs 34 that may share the processing tasks.

Figure 9:
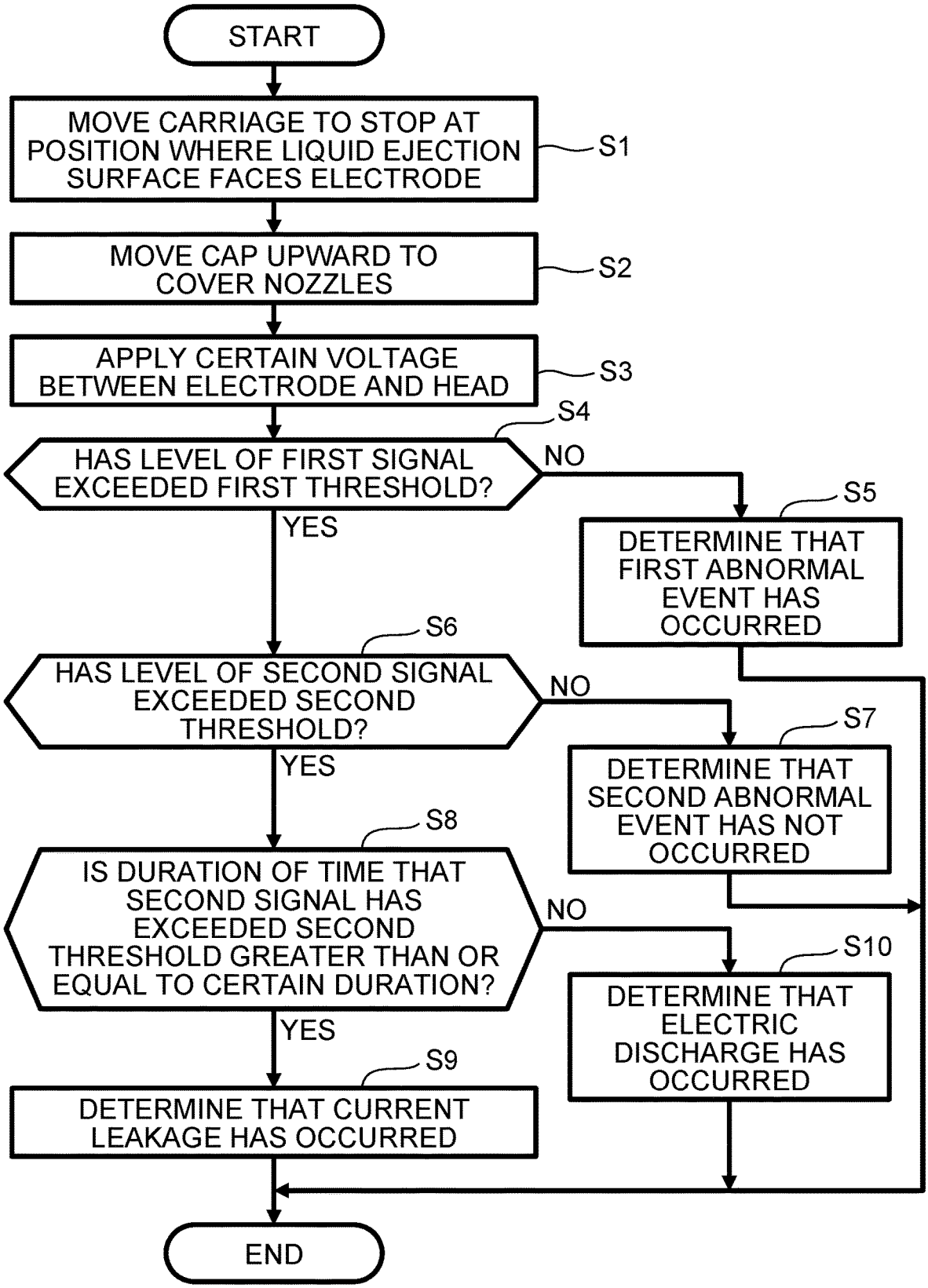
FIG. 9 is a flowchart of a procedure of detecting an abnormal event in the printer of FIG. 1.

Hereinafter, a description will be provided on a procedure for detecting an abnormal event in the printer 1. In this detection procedure, the presence or absence of a first abnormal event, i.e., an ejection failure, is determined first. More specifically, as illustrated in FIG. 9, the CPU 35 activates the carriage drive motor 21 to move the carriage 4 to a particular position where the ejection surface 5*a* of the head 5 faces the electrode 26 (step S1).

Subsequent to step S1, the CPU 35 operates the cap drive unit to move the cap 15 upward to intimately contact the cap 15 to the ejection surface 5*a* of the head 5 (step S2), thereby covering the orifices 41*a* of the nozzles 22.

Subsequent to step S2, the voltage controller 31 controls the voltage application circuit 25 to apply the certain voltage between the electrode 26 and the head 5 (step S3). In such a state, the controller 30 drives the driver IC 138 to provide a drive signal to a particular individual electrode 144. In a case where a nozzle 22 corresponding to the particular individual electrode 144 is a normal nozzle, ink is ejected from the nozzle 22 and thus the ejected ink reaches the electrode 26.

Subsequent to step S4, the first abnormal event determining unit 32 determines whether a first abnormal event has occurred in any nozzle 22. More specifically, the first abnormal event determining unit 32 determines whether the level of the first signal has exceeded the first threshold (step S4). If the first abnormal event determining unit 32 determines that the level of the first signal has not exceeded the first threshold (NO in step S4), the first abnormal event determining unit 32 determines that the first abnormal event has occurred in one or more nozzles 22 (step S5). That is, the head 5 has failed to eject enough ink from one or more nozzles 22.

If the first abnormal event determining unit 32 determines that the level of the first signal has exceeded the first threshold (YES in step S4), the second abnormal event determining unit 33 determines whether the level of the second signal has exceeded the second threshold (step S6). If the second abnormal event determining unit 33 determines that the level of the second signal has not exceeded the second threshold (NO in step S6), the second abnormal event determining unit 33 determines that the second abnormal event has not occurred (step S7). This refers that the first abnormal event has not occurred in any nozzle 22, and by extension, refers that the absence of an ejection failure, the absence of a current leakage, and the absence of an electric discharge have been correctly determined.

Figure 10:
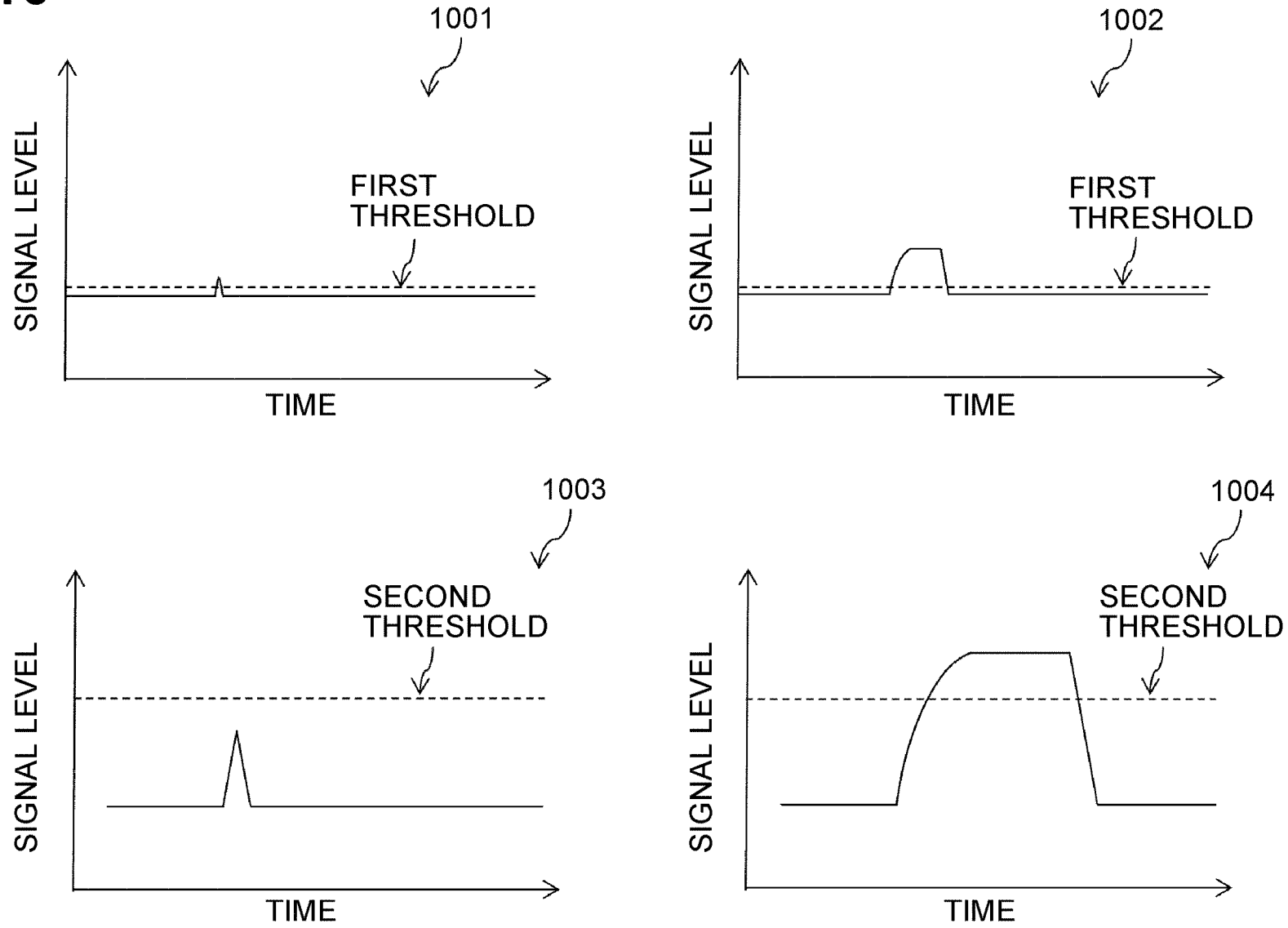
FIG. 10 illustrates charts each showing changes in level of a signal input to a first abnormal event determining unit or a second abnormal event determining unit of the printer 1 of FIG. 1.

FIG. 10 illustrates charts 1001, 1002, 1003, and 1004 each showing changes in level of a signal input to the first abnormal event determining unit 32 or the second abnormal event determining unit 33. The chart 1001 shows changes in level of a first signal input to the first abnormal event determining unit 32 in case where none of a first abnormal event and a second abnormal event has occurred. The chart 1002 shows changes in level of a first signal input to the first abnormal event determining unit 32 in case where a current leakage has occurred. The chart 1003 shows changes in level of a second signal input to the second abnormal event determining unit 33 in case where none of a first abnormal event and a second abnormal event has occurred. The chart 1004 shows changes in level of a second signal input to the second abnormal event determining unit 33 in case where a current leakage has occurred. Although not illustrated in FIG. 10, in a case where an electric discharge has occurred, a triangle waveform signal as a first signal is input to the first abnormal event determining unit 32 and a triangle waveform signal as a second signal is input to the second abnormal event determining unit 33. In a case where an electric discharge has occurred, the first signal and the second signal each rise to the same level as a corresponding one of the first signal and the second signal that rises in a case where a current leakage has occurred.

If the second abnormal event determining unit 33 determines that the level of the second signal has exceeded the second threshold (YES in step S6), the second abnormal event determining unit 33 determines that the second abnormal event has occurred. In other word, the second abnormal event determining unit 33 determines that ink is present between the ejection surface 5*a* and the electrode 26.

Hereinafter, a description will be provided on changes in voltage at the electrode 26 when an electric discharge or a current leakage occurs. An electric discharge causes the voltage applied between the ejection surface 5*a* and the electrode 26 to rise to a certain level greater than the second threshold and stay at that level for a relatively short duration. A current leakage causes the voltage applied between the ejection surface 5*a* and the electrode 26 to rise to the similar certain level and stay at that level for a longer duration than the duration of the voltage of the electrode 26 at the certain level caused by an electric discharge because the head 5 and the electrode 26 are electrically connected to each other via ink 60 accumulated between the ejection surface 5*a* and the electrode 26.

Referring to FIG. 9, if the second abnormal event determining unit 33 determines that the level of the second signal has exceeded the second threshold (YES in step S6), the second abnormal event determining unit 33 determines that a duration of time that the level of the second signal has exceeded the second threshold is greater than or equal to a certain duration (step S8). If the second abnormal event determining unit 33 determines that the duration of time that the level of the second signal has exceeded the second threshold is greater than or equal to the certain duration (YES in step S8), the second abnormal event determining unit 33 determines that a current leakage has occurred (step S9). In this case, the controller 30 operates the wiper 17 to wipe the ejection surface 5*a*. Thus, the ink 60 accumulated on the ejection surface 5*a* is removed, thereby eliminating the current leakage.

If the second abnormal event determining unit 33 determines that the duration of time that the level of the second signal has exceeded the second threshold is less than the certain duration (NO in step S8), the second abnormal event determining unit 33 determines that an electric discharge has occurred (step S10). In this case, the controller 30 operates the suction pump 16 to suck the accumulated ink 60 from the cap 15. Thus, the ink 60 accumulated on the electrode 26 is removed, thereby eliminating the electric discharge.

As described above, in the printer 1 according to the first illustrative embodiment, the first abnormal event determining unit 32 determines, based on the level of the first signal, whether a first abnormal event has occurred. Further, the second abnormal event determining unit 33 determines, based on the level of the second signal, whether a second abnormal event has occurred. In other words, the presence or absence of a first abnormal event and the presence or absence of a second abnormal event may be detected individually. Thus, the first abnormal event determining unit 32 may correctly determine whether a first abnormal event has occurred. Moreover, the second abnormal event determining unit 32 may correctly determine whether a second abnormal event has occurred. If the second abnormal event determining unit 32 determines that a second abnormal event has occurred, the second abnormal event may be eliminated by maintenance in a maintenance manner suitable for the second abnormal event. If the first abnormal event determining unit 32 determines that a first abnormal event has not occurred, the second abnormal event determining unit 32 determines whether a second abnormal event has occurred. Consequently, the reliability of the printer 1 may be increased.

A current leakage is caused by ink 60 accumulated on both the ejection surface 5*a* and the electrode 26. Thus, the current leakage may be highly likely to be eliminated by wiping ink from the ejection surface 5*a*. Consequently, as described above, in the printer 1 according to the first illustrative embodiment, in a case where a current leakage has occurred, ink is removed using the wiper 17 without using the suction pump 16. That is, the suction pump 16 is not operated in maintenance for a current leakage because maintenance using the suction pump 16 takes a relatively long time to be completed. Thus, a current leakage may be eliminated in a relatively short time.

In the printer 1 according to the first illustrative embodiment, when the second abnormal event determining unit 32 determines whether a second abnormal event has occurred, the controller 30 drives the driver IC 138 to provide a drive signal to each individual electrode 144 to cause the head 5 to eject ink from each nozzle 22 while the voltage application circuit 25 applies the certain voltage between the electrode 26 and the head 5. Nevertheless, it may be modified such that when the first abnormal event determining unit 32 determines whether a second abnormal event has occurred, although the voltage application circuit 25 applies the certain voltage between the head 5 and the electrode 26, the controller 30 does not drive the driver IC 138 for providing a drive signal to each individual electrode 144. In this case, the second abnormal event determining unit 33 compares the level of the second signal input to the second abnormal event determining unit 33 with the second threshold. Based on the comparison result, the second abnormal event determining unit 33 may determine whether a second abnormal event has occurred. In this case, also, the controller 30 may execute the steps S1 to S5 of the detection procedure according to the first illustrative embodiment to determine whether a first abnormal event has occurred.

In this case, also, as with the first illustrative embodiment, the first abnormal event determining unit 32 may correctly determine whether a first abnormal event has occurred. Further, the second abnormal event determining unit 33 may correctly determine whether a second abnormal event has occurred. If the second abnormal event determining unit 33 determines that a second abnormal event has occurred, the second abnormal event may be resolved by maintenance in a maintenance manner suitable for the second abnormal event. If the first abnormal event determining unit 32 determines that a first abnormal event has not occurred, the second abnormal event determining unit 33 determines whether a second abnormal event has occurred. Consequently, the reliability of the printer 1 may be increased.

Second Illustrative Embodiment

Figure 11:
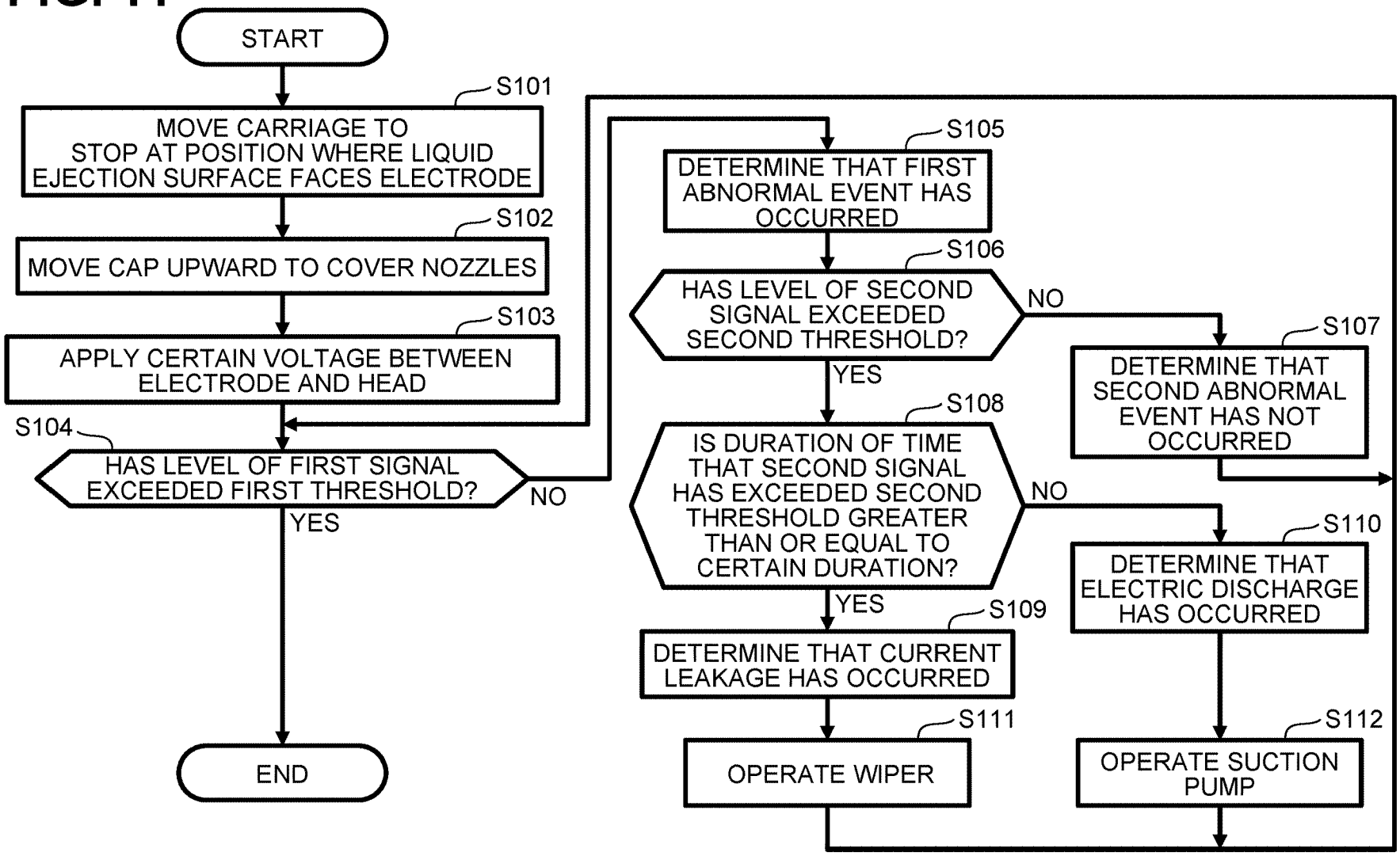
FIG. 11 is a flowchart of another procedure of detecting an abnormal event in the printer of FIG. 1.

Referring to FIG. 11, a description will be provided on a procedure for detecting an abnormal event in the printer 1 according to a second illustrative embodiment. The detection procedure according to the second illustrative embodiment includes steps S101 to S110 of which details are the same as those executed in steps S1 to S10, respectively, of the detection procedure according to the first illustrative embodiment, and therefore, a detailed description for steps S101 to S110 is omitted. In the first illustrative embodiment, based on the determination that a first abnormal event has not occurred, the second abnormal event determining unit 33 determines whether a second abnormal event has occurred. In the second illustrative embodiment, after the determination that a first abnormal event has occurred, the second abnormal event determining unit 33 determines whether a second abnormal event has occurred. If the second abnormal event determining unit 33 determines that a second abnormal event has occurred, the controller 30 executes maintenance in a suitable maintenance manner. Thereafter, the first abnormal event determining unit 32 determines again whether a first abnormal event (i.e., an ejection failure) has occurred.

In step S104, the first abnormal event determining unit 32 determines whether the level of the first signal has exceeded the first threshold. If the first abnormal event determining unit 32 determines that the level of the first signal has exceeded the first threshold (YES in step S104), the first abnormal event determining unit 32 determines that the first abnormal event has not occurred in any nozzle 22. The procedure thus ends.

If the first abnormal event determining unit 32 determines that the level of the first signal has not exceeded the first threshold (NO in step S104), the first abnormal event determining unit 32 determines that an ejection failure has occurred in one or more nozzles 22 (step S105). Subsequent to step S105, the second abnormal event determining unit 33 determines whether the level of the second signal has exceeded the second threshold (e.g., step S106). If the second abnormal event determining unit 33 determines that the level of the second signal has not exceeded the second threshold (NO in step S106), the second abnormal event determining unit 33 determines that the second abnormal event has not occurred (step S107).

If the second abnormal event determining unit 33 determines that the level of the second signal has exceeded the second threshold (YES in step S106), the second abnormal event determining unit 33 determines that a duration of time that the level of the second signal has exceeded the second threshold is greater than or equal to the certain duration (step S108). If the second abnormal event determining unit 33 determines that the duration of time that the level of the second signal has exceeded the second threshold is greater than or equal to the certain duration (YES in step S108), the second abnormal event determining unit 33 determines that a current leakage has occurred (step S109). Subsequent to step S109, the controller 30 operates the wiper 17 to wipe the ejection surface 5*a* (step S111). Thus, the ink 60 accumulated on the ejection surface 5*a* is removed, thereby eliminating the current leakage.

If the second abnormal event determining unit 33 determines that the duration of time that the level of the second signal has exceeded the second threshold is less than the certain duration (NO in step S108), the second abnormal event determining unit 33 determines that an electric discharge has occurred (step S110). Subsequent to step S110, the controller 30 operates the suction pump 16 to suck the accumulated ink from the cap 15. (step S112). Thus, the ink 60 accumulated on the electrode 26 is removed, thereby eliminating the electric discharge. Subsequent to step S111 or S112, the first abnormal event determining unit 32 determines whether the level of the first signal has exceeded the first threshold ( ). That is, the first abnormal event determining unit 32 again determines whether an ejection failure has occurred.

In the second illustrative embodiment, also, as with the first illustrative embodiment, the first abnormal event determining unit 32 may correctly determine whether a first abnormal event has occurred and the second abnormal event determining unit 33 may correctly determine whether a second abnormal event has occurred. If the second abnormal event detecting unit 32 determines that a second abnormal event has occurred after the first abnormal event detecting unit determines that a first abnormal event has occurred, the second abnormal event may be eliminated by maintenance in a maintenance manner suitable for the second abnormal event. After the second abnormal event is resolved, the first abnormal event detecting unit 32 determines again whether a first abnormal event has occurred. Consequently, the reliability of the printer 1 may be increased.

Modifications

In the first and second illustrative embodiments, the electrode 26 is disposed inside the cap 15. Alternatively, the electrode 26 may be disposed at the platen 8. Further alternatively, an electrode area may be provided outside the cap 15.

In the first and second illustrative embodiments, the voltage application circuit 25 applies a positive voltage between the electrode 26 and the head 5. Alternatively, the voltage application circuit 25 may apply a negative voltage between the electrode 26 and the head 5.

In the printer 1 according to the first and second illustrative embodiments, moving the carriage 4 by the carriage drive motor 21 causes the head 5 to move relative to the cap 15. Alternatively, only the cap 15 or both of the head 5 and the cap 15 may be movable.

In the printer 1 according to the first and second illustrative embodiments, in a state where the cap 15 covers the orifices 41*a* of the nozzles 22, the controller 30 determines whether a first abnormal event has occurred and whether a second abnormal event has occurred. Alternatively, in a state where the head 5 and the electrode 26 face each other without the cap 15 covering the orifices 41*a* of the nozzles 22, the controller 30 may execute step S3 and its subsequent steps. That is, the routine may skip step S2. More specifically, in one example, the controller 30 may execute step S3 and its subsequent steps in a state where the cap 15 is located at a position where the cap 15 is closer to the head 5 than the cap 15 located during printing and does not contact the ejection surface 5*a*. In another example, the controller 30 may execute step S3 and its subsequent steps in a state where the cap 15 is in a standby state, that is, the cap is located at its lowest position.

The disclosure has been applied to the printer 1 including the serial head 5 that moves in the scanning direction together with the carriage 4 and ejects ink from the nozzles 22. Alternatively, the printer 1 may include a line head extending over the entire length of a recording sheet in the scanning direction, instead of the serial head.

The disclosure has been applied to a printer that ejects ink from nozzles to record an image on a recording sheet P. The disclosure may also be applied to another printer that may record an image on a recording medium other than a recording sheet. Examples of the recording media include a T-shirt, a sheet for outdoor advertisement, a casing of a mobile terminal such as a smartphone, a corrugated cardboard, and a resin member. Further, the disclosure may also be applied to a liquid ejection apparatus that may eject liquid other than ink such as liquid resin or liquid metal.

While the disclosure has been described in detail with reference to the specific embodiments thereof, these are merely examples, and various changes, arrangements and modifications may be applied therein without departing from the spirit and scope of the disclosure.

What is claimed is:

1. A printer comprising:

a head having an ejection surface having a nozzle, the head being configured to eject liquid from the nozzle;

an electrode;

a moving unit configured to move at least one of the electrode or the head;

a voltage application circuit configured to apply a certain voltage between the head and the electrode;

a controller configured to:

drive the moving unit such that the ejection surface faces the electrode;

drive the voltage application circuit to apply the certain voltage between the head and the electrode;

compare a level of an output signal with a particular threshold, the output signal being output from the electrode and input to the controller; and based on the comparison result, determine that liquid is present between the ejection surface and the electrode;

an amplifier;

a first connecting line connected between the electrode and the amplifier;

a second connecting line connected between the amplifier and the controller; and a third connecting line connected directly between the electrode and the controller, wherein:

the output signal includes a first signal input to the controller from the electrode via the first and second connecting lines and a second signal input directly to the controller from the electrode via the third connecting line, the controller is further configured to:

determine whether a level of the first signal has exceeded a further particular threshold;

in response to a determination that the level of the first signal has not exceeded the further particular threshold, determine that a first abnormal event has occurred;

in response to a determination that the level of the first signal has exceeded the further particular threshold, determine whether the second signal has exceeded the particular threshold, the particular threshold being greater than the further particular threshold; and in response to a determination that the level of the second signal has exceeded the particular threshold, determine that a second abnormal event has occurred.

2. The printer according to claim 1, further comprising a relay circuit connected to the electrode and configured to relay the output signal to the controller.

3. The printer according to claim 2, wherein the controller is further configured to, based on a level of an output signal, determine that the head has failed to eject enough liquid from the nozzle, the output signal being input to the controller from the electrode via the relay circuit.

4. The printer according to claim 1, further comprising a cap configured to cover the nozzle, wherein the electrode is disposed inside the cap.

5. The printer according to claim 1, wherein the controller is further configured to:

in response to the determination that the level of the second signal has exceeded the particular threshold, determine whether a duration of time that the level of the second signal has exceeded the particular threshold is greater than or equal to a certain duration;

in response to a determination that the duration of time that the level of the second signal has exceeded the particular threshold is greater than or equal to the certain duration, determine that a current leakage has occurred; and in response to a determination that the duration of time that the level of the second signal has exceeded the particular threshold is less than the certain duration, determine that an electric discharge has occurred.

6. The printer according to claim 5, further comprising:

a cap configured to cover the nozzle;

a wiper configured to wipe the ejection surface; and a suction pump connected to the cap, wherein the controller is further configured to:

in response to the determination that the current leakage has occurred, operate the wiper; and in response to the determination that the electric discharge has occurred, operate the suction pump.

7. A method for detecting an abnormal event in a printer, the printer including:

a head having an ejection surface having a nozzle, the head configured to eject liquid from the nozzle;

an electrode;

a moving unit configured to move at least one of the electrode or the head;

a voltage application circuit configured to apply a certain voltage between the head and the electrode;

an amplifier;

a first connecting line connected between the electrode and the amplifier;

a second connecting line connected from the amplifier; and a third connecting line connected directly from the electrode, the method comprising:

causing the ejection surface and the electrode to face each other;

applying the certain voltage between the head and the electrode;

comparing a level of an output signal with a particular threshold, the output signal being output from the electrode, and wherein the output signal includes a first signal input from the electrode via the first and second connecting lines and a second signal input directly from the electrode via the third connecting line;

based on the comparison result, determining that liquid is present between the liquid ejection surface and the electrode;

determine that a level of the first signal has exceeded a further particular threshold; and in response to a determination that the level of the first signal has exceeded the further particular threshold, determine that the second signal has exceeded the particular threshold, the particular threshold being greater than the further particular threshold; and in response to a determination that the level of the second signal has exceeded the particular threshold, determine that an abnormal event has occurred.

8. A method for detecting an abnormal event in a printer, the printer including:

a head having an ejection surface having a nozzle, the head configured to eject liquid from the nozzle;

an electrode;

a moving unit configured to move at least one of the electrode or the head;

a voltage application circuit configured to apply a certain voltage between the head and the electrode;

a relay circuit connected to the electrode;

a cap configured to cover the nozzle;

a wiper configured to wipe the ejection surface; and a suction pump connected to the cap, the method comprising:

causing the ejection surface and the electrode to face each other;

applying the certain voltage between the head and the electrode;

determining that a level of a first signal has not exceeded a first threshold, the first signal being output from the electrode via the relay circuit;

in response to a determination that the level of the first signal has not exceeded the first threshold, determining that a level of a second signal has exceeded a second threshold, the second signal being output from the electrode directly;

in response to a determination that the level of the second signal has exceeded the second threshold, executing maintenance;

subsequent to executing the maintenance, applying the certain voltage between the head and the electrode; and determining whether the level of the first signal output from the electrode has exceeded the first threshold.

9. The method according to claim 8, wherein executing the maintenance comprises operating the wiper.

10. The method according to claim 9, further comprising:

in response to the determination that the level of the second signal has exceeded the second threshold, determining that a duration of time that the level of the second signal has exceeded the second threshold is greater than or equal to a certain duration, wherein the wiper is operated in the maintenance in response to a determination that the duration of time that the level of the second signal has exceeded the second threshold is greater than or equal to the certain duration.

11. The method according to claim 8, wherein executing the maintenance comprises operating the suction pump.

12. The method according to claim 11, further comprising:

in response to the determination that the level of the second signal has exceeded the second threshold, determining that a duration of time that the level of the second signal has exceeded the second threshold is greater than or equal to a certain duration, wherein the suction pump is operated in the maintenance in response to a determination that the duration of time that the level of the second signal has exceeded the second threshold is less than the certain duration.

* * * * *